United States Patent [19]

Kanazawa et al.

[11] Patent Number: 4,801,272

[45] Date of Patent: Jan. 31, 1989

[54] EXTERNAL PACK CONNECTOR

[75] Inventors: Manabu Kanazawa, Tokyo; Kazuyoshi Odagawa, Koshigaya, both of Japan

[73] Assignee: Canon Kabushiki Kaisha, Tokyo, Japan

[21] Appl. No.: 13,149

[22] Filed: Feb. 10, 1987

Related U.S. Application Data

[63] Continuation of Ser. No. 730,037, May 3, 1985, abandoned.

[30] Foreign Application Priority Data

| | | | |
|---|---|---|---|
| May 10, 1984 | [JP] | Japan | 59-91727 |
| May 10, 1984 | [JP] | Japan | 59-91728 |
| May 10, 1984 | [JP] | Japan | 59-91729 |
| May 15, 1984 | [JP] | Japan | 59-95493 |
| May 15, 1984 | [JP] | Japan | 59-95494 |
| May 15, 1984 | [JP] | Japan | 59-95495 |

[51] Int. Cl.[4] ..... H01R 13/62

[52] U.S. Cl. ..... 439/153; 439/267; 439/270; 439/325

[58] Field of Search ..... 339/45 R, 45 M, 46, 339/75 M, 75 MP, 74 R; 74/54, 107; 439/152, 153, 260, 266, 267, 270, 325-328, 180

[56] References Cited

U.S. PATENT DOCUMENTS

| | | | |
|---|---|---|---|
| 148,008 | 2/1874 | Vannette | 74/54 |
| 152,806 | 7/1874 | Montague | 74/54 |
| 3,635,184 | 1/1974 | Liautaud | 339/75 M |
| 4,118,094 | 10/1978 | Key | 339/75 MP |
| 4,141,616 | 2/1979 | Gottlieb | 339/75 M |
| 4,221,448 | 9/1980 | Logerot et al. | 339/75 MP |
| 4,487,468 | 12/1984 | Fedder et al. | 339/75 MP |
| 4,533,192 | 8/1985 | Kelley | 339/45 M |

*Primary Examiner*—John McQuade

*Attorney, Agent, or Firm*—Fitzpatrick, Cella, Harper & Scinto

[57] ABSTRACT

An external pack connector has a recess for receiving an external pack, a table member slidably mounted in the recess and biased oppositely to a direction of insertion of the external pack, a resilient contact member projecting into the recess, and a rotatable lever engaged with the table member and the contact member and rotatable against a spring force of the contact member.

9 Claims, 12 Drawing Sheets

EXTERNAL PACK CONNECTOR

This application is a continuation-in-part of application Ser. No. 730,037, filed May 3, 1985, now abandoned.

BACKGROUND OF THE INVENTION

1. Field of the Invention

The present invention relates to a connector contained in electronic equipment, and more particularly to an external memory pack connector which electrically and physically connects an external memory pack containing a memory element such as ROM or RAM and a main body of electronic equipment.

2. Description of the Prior Art

In the past, connection of a connector of electronic equipment and an external memory pack has been usually made by inserting terminals of a printed circuit board of the external memory pack into the connector or urging them to an outer case. However, in the former case, there is a problem in durability, and in the latter case, a portion of the outer case is deformed by pressure of the contacts and sufficient contact pressure is not obtained. Further, in both cases, the operability by a user is very poor.

In Figs. 1A, 1B, 1C, 2 and 3, numeral 101 denotes a connector body, numeral 102 denotes an insertion port into which an external memory pack 10 is inserted, numeral 104 denotes connector contacts to be contacted to the external memory pack 10, and numeral 103 denotes an external memory pack removal lever by which the external memory pack 10 inserted into the insertion port 102 is removed.

FIGS. 2 and 3 show sectional views of the connector of FIG. 1 and show internal structures thereof. In FIG. 2, the external memory pack 10 is not inserted. The connector contacts 104 have constant spring forces to flex them in a direction B. The removal lever 103 has a projection 107 with which tip ends of the connector contacts 104 engage. Thus, the removal lever 103 tends to be rotated by the spring forces of the connector contacts 104 in a direction C around a pivot point 103A. Numeral 105 denotes a vertically movable platform which is urged toward the removal lever 103 by a leaf spring 106. The movable platform 105 has a projection 109 with which an end of the removal lever 103 engages. The rotation of the removal lever 103 in the direction C is suppressed by this engagement. Thus, the spring forces of the connector contacts 104 in the direction B are suppressed by the engagement of the removal lever 3 by the projection 109. Thus, the position shown in FIG. 2 is maintained stably.

Let us assume that the external memory pack 10 is inserted into the insertion port 102 in a direction D. As the external memory pack 10 is inserted into the insertion port 102 and the movable platform 105 is moved down to a position at which the removal lever 103 and the projection 109 of the movable platform 105 are disengaged from each other, the removal lever 103 is rotated in the direction C by the spring pressures of the connector contacts 104 in the direction B so that the removal lever 103 slips onto the top 108 of the movable platform 105 to prevent the lifting of the movable platform 105. The connector contacts 104 are flexed in the direction B and contacts to the contact pattern 10A of the external memory pack 10. This position is shown in FIG. 3.

The removal operation of the external memory pack 10 is now explained. In FIG. 3, as the removal lever 103 is rotated in the direction A (this operation requires a force larger than a predetermined force because it is against the spring forces of the connector contacts 04), the connector contacts 104 are urged oppositely to the direction B by the projection 107 of the removal lever 103, and the contact pattern 10A of the external memory pack 10 and the connector contacts 104 are disengaged from each other. As the removal lever 103 is rotated in the direction A and disengaged from the top 108 of the movable platform 105, the movable platform 105 is lifted by the leaf spring 106 and pushes up the external memory pack 10 and the projection 109 of the movable platform 105 again engages with the removal lever 103. As a result, the rotation of the removal lever 103 in the direction C by the spring pressures is inhibited. Thus, the position before the insertion of the external memory pack is restored.

In such a prior art connector, if an operator advertently or inadvertently removes the inserted external memory pack 10 during the access to it by the equipment, it leads to the destruction of the program and breakage of the connector contacts 104 because the connector contacts 104 are press-contacted to the contact pattern 10A of the external memory pack 10.

Further detail will be explained with reference FIGS. 4A to 4C and 5A to 5C. FIGS. 4A, 4B, and 4C are respectively a top view, front view and side view of the connector. Numeral 201 denotes a connector body, numeral 202 denotes an insertion port for the external memory pack 10 and which is shaped to fit the external memory pack 10, and numeral 203 denotes connector contacts.

FIGS. 5A, 5B and 5C show sectional views of the connector taken along a line 5A—5A in FIG. 4A. FIG. 5A shows a contact position in which the contacts 203 project into the insertion port 202, FIG. 5B shows a non-contact position, and FIG. 5C shows a position in which the external memory pack 10 is inserted.

The contacts 203 have spring pressures which normally flex the contacts 203 in a direction a. Because of the contact pressure afforded by the spring forces, the stable contact is maintained. Numeral 204 denotes a lever which is rotated around a pivot point 210. Terminals of the contacts 203 engage with a tip end 206 of the lever 204. The lever 204 tends to be rotated oppositely to the direction A by the spring forces of the contacts 203, but it is held in the position shown in FIG. 5A by a projection 207 on an upwardly and downwardly movable platform 205.

When the external memory pack 10 is to be inserted into the connector, the lever 204 is manually rotated in the direction A. As the lever 204 is rotated, the movable platform 205 is moved in the direction B by the leaf spring 208 and it is lifted to the position shown in FIG. 5B. Even if the lever 204 is no longer rotated in the direction A, the lever 204 is secured by the sloped surface of the movable platform 205 so that it is not returned to the position of FIG. 5A by the spring forces of the contacts 203 and is held at the position of FIG. 5B. At this time, the contacts 203 do not project into the insertion port 202 and are in the non-contact position.

As the external memory pack 10 is inserted from the insertion port 202 and the movable platform 205 is pushed down in the direction C against the spring force of the leaf spring 208, the lever 204 is disengaged from the sloped surface 209 of the movable platform 205 and rotated by the spring forces of the contacts 203 in the direction D around the pivot point 210. The contacts 203 project from the insertion port 202 and put in the contact position. This is shown in FIG. 5C.

However, in order to rotate the lever 204 of the connector in the direction A, it must be rotated against the spring forces of the contacts 203 and the load thereof is usually larger than 5 Kg. Thus, the operation is very difficult. It is not possible to automatically operate the lever without intervention of the operator.

SUMMARY OF THE INVENTION

It is an object of the present invention to provide an external pack connector which contacts by spring forces of contacts and which can be readily removed.

It is another object of the present invention to provide an external pack connector which holds the external pack unremoved by a pin.

It is other object of the present invention to provide an external pack connector having securing means for the external pack formed in a rotary member to facilitate removal of the external pack.

It is other object of the present invention to provide an external pack connector having drive means for driving a member which secures the external pack.

It is other object of the present invention to provide an electronic equipment which can accommodate a memory pack and indicate release of securing of the memory pack by indication means.

It is other object of the present invention to provide an external pack connector which assures positive contact by urging and disengaging contacts of the external pack by drive means.

DETAILED DESCRIPTION OF THE PREFERRED EMBODIMENTS

(1) First embodiment

Figure 6A:
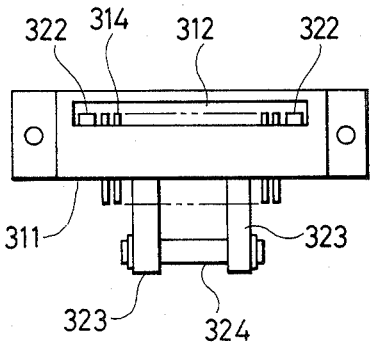
FIGS. 6A and 6B are a plan view and a side view of one embodiment of an external memory pack connector of the present intention.
Figure 6B:
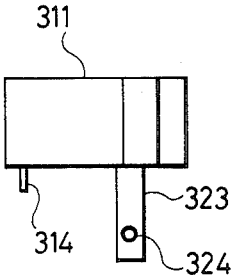
Figure 7:
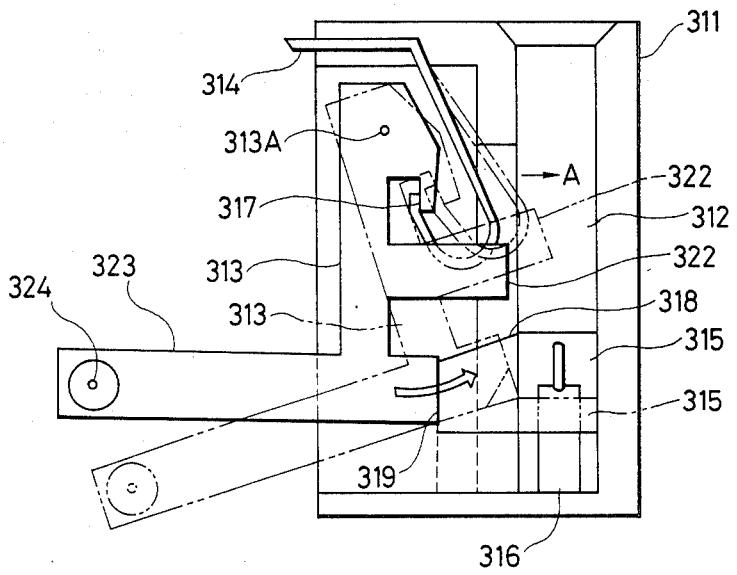
FIG. 7 is a side sectional view of the connector of FIG. 6A and 6B.

Referring to FIGS. 6A, 6B and 7, numeral 311 denotes a connector body of a connector in accordance with a first embodiment of the present invention, numeral 312 denotes an insertion port for an external memory pack 10, and numeral 313 denotes a removal lever which is pivoted at a shaft 313A to the connector body 311 and which is pivotable around the shaft 313A. A projection 317 and lock pins 322 extending toward the insertion port 312 are formed on the removal lever 313 which also has movable levers 323 extending outwardly of the connector body 311 from the bottom of the removal lever 313. Two movable levers 323 extend from the removal lever 313 as shown in FIG. 6A and a shaft 324 extends between ends of the movable levers 323. Two lock pins 322 are arranged on the opposite sides of the removal lever 313 as shown in FIG. 6A.

Numeral 314 denotes connector contacts having ends thereof fixed to the top of the connector body 311. The other ends of the connector contacts are folded in the opposite direction as shown and the folded ends engage the projection 317 of the removal lever 313. The connector contacts 314 have spring forces to flex in a direction A to apply a rotating force in the direction A to the removal lever 314. Numeral 315 denotes a vertically movable platform arranged at the bottom of the insertion port 312. It is normally urged upwardly by a leaf spring 316. In the pushed-up position of the movable platform 315, the bottom end of the removal lever 313 abuts against the side 319 of the movable platform 315 so that the position shown is kept. In this position, the ends of the connector contacts 314 are bent in the opposite direction to the direction A and are out of the insertion port 312 The distance between the lever 323 and the point of contact at projection 317 at which lever 313 engages connector 314 is greater than the distance between the pivot point 313A around which lever 313 pivots and projection 317.

The operation of the connector of the present embodiment will now be explained.

Figure 8:
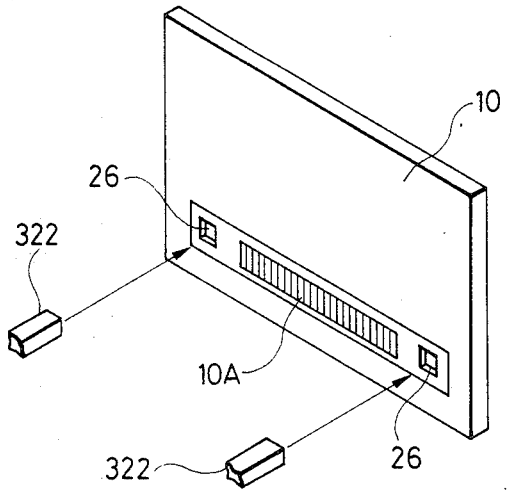
FIG. 8 is a plan view of the external memory pack to be connected to the connector of the embodiment.

As the external memory pack 10 is inserted into the insertion port 312 and the movable platform 315 is pushed downwardly against the leaf spring 316, the removal lever 313 rides on the sloped surface 318 of the movable platform 315 because the spring forces of the connector contacts 314 act in the direction A and the removal lever 313 is rotated around the shaft 313A to a position shown by double-dot chain line. The ends of the connector contacts 314 project into the insertion port 312 as shown by double-dot chain line and contact to the contact pattern 10A of the external memory pack 10 to make an electrical connection. The lock pins 322 of the removal lever 313 project into the insertion port 312 and extends into lock holes 26 formed in the external memory pack 10 at a position facing the lock pin 322 as shown in FIG. 8. Thus, the external memory pack 10 is fixed in the insertion port 312 and cannot be removed by an external force.

In order to remove the external memory pack 10, the movable lever 323 of the removal lever 313 is pushed upwardly to a position shown by a solid line so that the lock pins 322 which are in union with the removal lever 313 is disengaged from the lock holes 26 of the external memory pack 10 as the connector contacts 314 are disengaged, and each lock pin 322 moves away from the insertion port 312, the bottom of the removal lever 313 moves away from the inclined surface 318 of the movable table 315 which is then pushed upwardly by the leaf spring 316, and the external memory pack 10 is pushed out of the insertion port 312 by the movable table 315.

In the prior art connector, if a user removes the external memory pack while the external memory pack contacts to the connector contacts of the connector, a program may be destroyed or the connector contacts may be broken. In the connector of the present embodiment, the lock pins 322 which are linked to the connector contacts 324 are inserted into lock holes 26 of the external memory pack 10 in the contact position to prevent the removal of the external memory pack 10. Accordingly, the problem encountered in the prior art connector is resolved.

As described above, in accordance with the present invention, the removal of the external memory pack 10 in the contact position is prevented because the lock pins secure the external memory pack as it contacts to the connector contacts. Since the mechanism to prevent the removal of the external memory pack comprises only the lock pins which are in union with the removal lever and the lock holes, the structure is very simple.

(2) Second embodiment

Figure 1A:
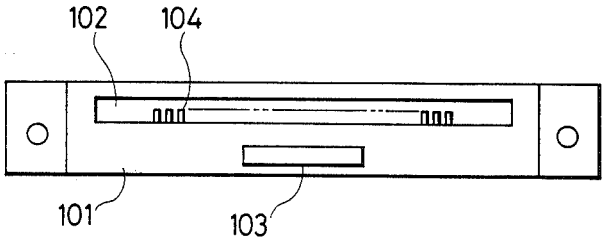
FIG. 1A PRIOR ART
Figs. 1A, 1B and 1C are a plan view, a front view and a side view, respectively, of a prior art external memory pack connector.
Figure 1B:
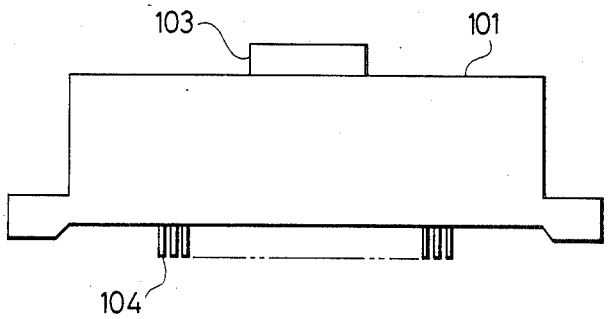
FIG. 1B PRIOR ART
Figure 1C:
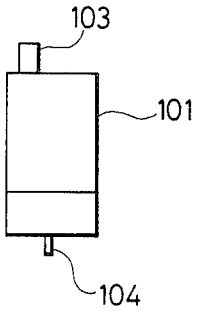
FIG. 1C PRIOR ART
Figure 2:
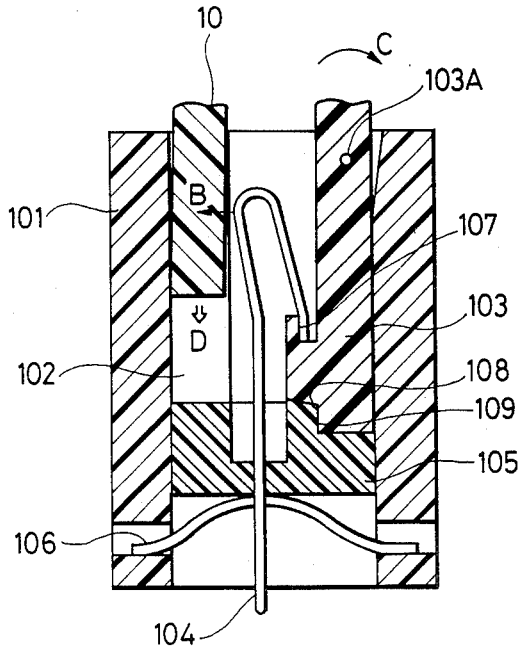
FIG. 2 PRIOR ART
FIGS. 2 and 3 are sectional views illustrating the operation of the connector of FIG. 1, FIGS. 4A, 4B and 4C are external views of a prior art connector.
Figure 3:
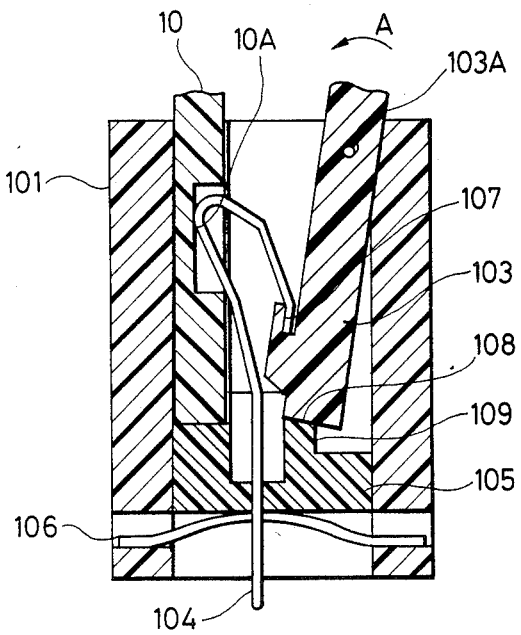
FIG. 3 PRIOR ART
Figure 4A:
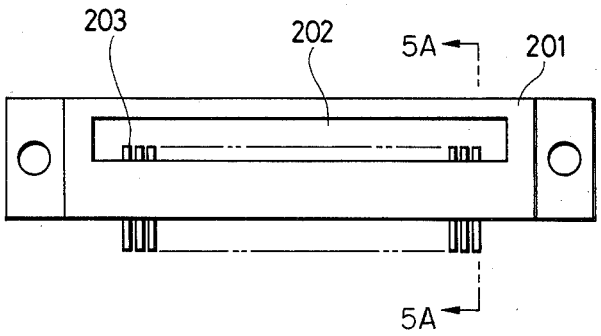
FIG. 4A PRIOR ART
Figure 4B:
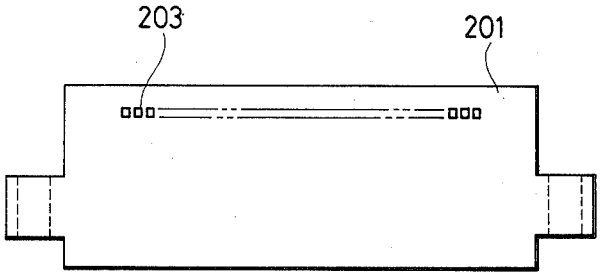
FIG. 4B PRIOR ART
Figure 4C:
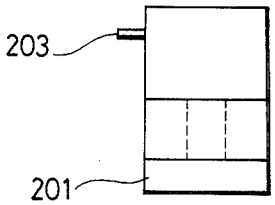
FIG. 4C PRIOR ART
Figure 5A:
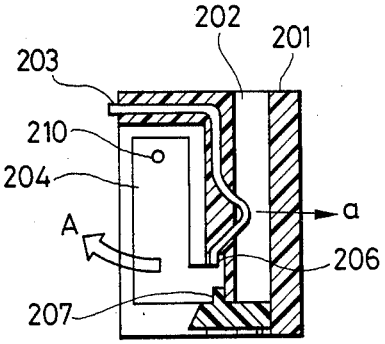
FIG. 5A PRIOR ART
FIGS. 5A, 5B and 5C are sectional views illustrating control for movement of contacts of the prior art connector.
Figure 5B:
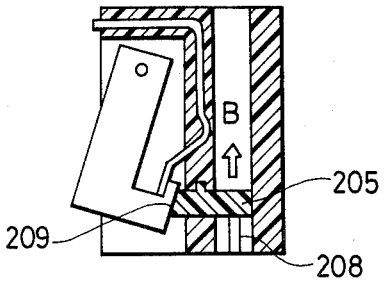
FIG. 5B PRIOR ART
Figure 5C:
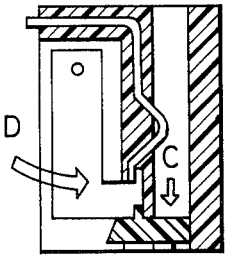
FIG. 5C PRIOR ART

FIGS. 9A to 12B show another embodiment of the connector of the present invention, in which the like elements shown in FIGS. 5A to 5C are designated by the like numerals. Numeral 204' denotes movable levers which are extensions of the lever 204 shown in FIG. 5A. Two movable levers 204' extend from the connector body 201 and other levers 204 are linked to the movable lever 204' A shaft 412 extending through a collar 413 is fixed to the two movable levers 204' by E-rings 414. The collar 413 is rotatable around the shaft 412. Numeral 411 denotes a cam.

Figure 9A:
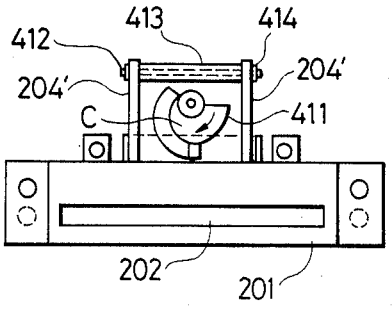
FIGS. 9A and 9B are a plan view and a sectional view showing a contact position of contacts at an initial position of a cam in the embodiment.
Figure 9B:
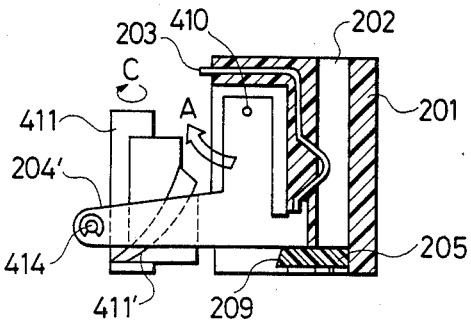

Like in the embodiment of FIGS. 5A to 5C, the contacts 203 are put in the non-contact position by rotating the levers 204' in the direction A in FIG. 9B. In the present embodiment, the levers are rotated by the rotation of the cam 411.

As shown in FIGS. 9A and 9B, the cam 411 and the collar 413 are in the non-contact position and the levers and the contacts are in the same position as that in FIG. 5A.

Figure 10A:
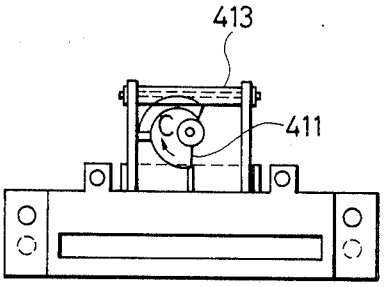
Figs. 10A and 10B are a plan view and a sectional view showing the initial rotational position of the cam in the embodiment.
Figure 10B:
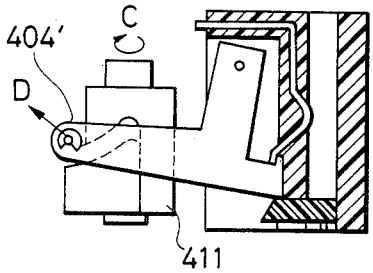

The cam 411 is rotated in the direction C. As the cam surface 411' which is a portion of the cam 411 captures the collar 413, the movable levers 204' are rotated in the direction A around the pivot point 410 against the spring forces of the contacts 203. As the cam 411 rotates, the movable levers 204' are slightly rotated in the direction A, as shown in FIGS. 10A and 10B.

Figure 11A:
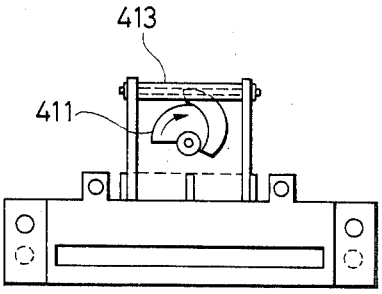
FIGS. 11A and 11B are a plan view and a sectional view showing an external position when the cam is further rotated to keep the contacts in a non-contact position.
Figure 11B:
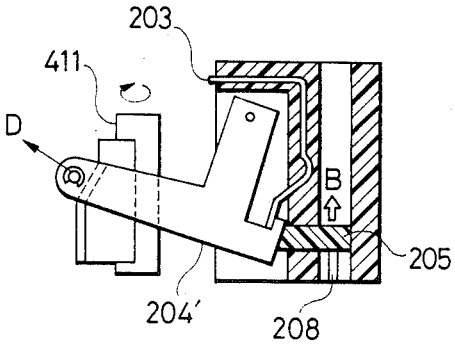

As the cam 411 is further rotated to a position shown in FIG. 11A, the movable levers 204' are further rotated, the movable platform 205 is moved in the direction B by the leaf spring 208 to a position shown in FIG. 11B to lock the movable levers 204'.

Figure 12A:
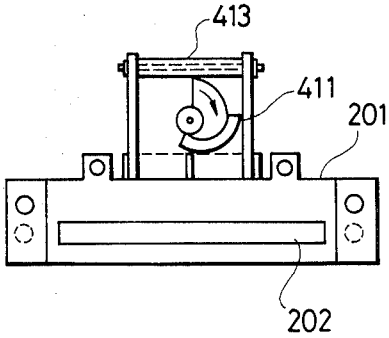
FIGS. 12A and 12B are a plan view and a sectional view showing the non-contact position of the contacts at the end of the drive of the cam.
Figure 12B:
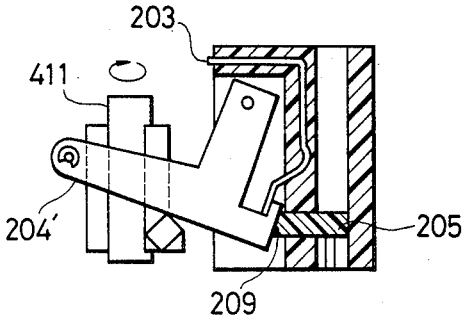

As the cam 411 is further rotated, the contacts 203 are held retracted from the insertion port 202 by the sloped surface 209 of the movable platform 205 even if the collar 413 of the movable levers 204' is released by the cam 411 as shown in FIGS. 12A and 12B.

Under this position, if the external memory pack 10 to the contacts 203 of the circuit board is inserted into the insertion port 202, the movable platform 205 is pushed down, the movable levers 204' are disengaged from the sloped surface 209 and the contacts 203 are put in the contact position.

Figure 13A:
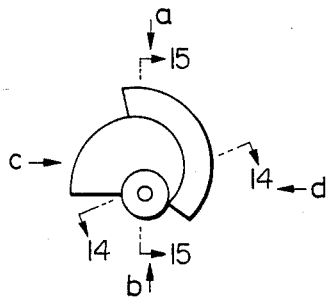
FIGS. 13A to 13B are a top view, a front view, a rear view, a right side view and a left side view, respectively, of, the cam in the embodiment.
Figure 13B:
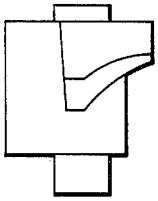
Figure 13C:
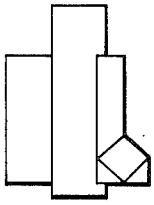
Figure 13D:
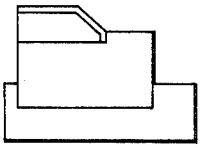
Figure 13E:
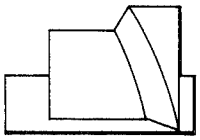

FIGS. 13A to 13E show detailed views of the cam 411. FIG. 13A is a top view of the cam 411 as viewed from the top of the insert on port 202, FIG. 13B is a side view of the cam 411 as viewed in the direction a of FIG. 13A, FIG. 13C is a side view of the cam 411 as viewed in the direction b in FIG. 13A, FIG. 13D is a side view of the cam 411 as viewed in the direction c in FIG. 13A, and FIG. 13E is a side view of the cam 411 as viewed in the direction d in FIG. 13A.

Figure 14:
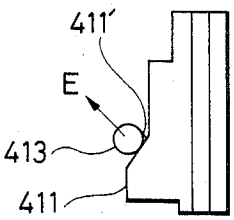
FIG. 14 is a sectional view of the cam taken along a line 14—14, in FIG. 13A.
Figure 15:
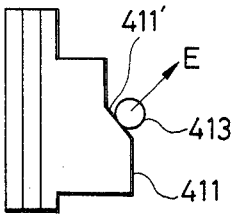
FIG. 15 is a sectional view of the cam taken along a line 15—15 in FIG. 13B, FIGS. 16A and 16B are a plan view and a side view of electronic equipment equipped with the connector of the embodiment.

FIG. 14 shows a sectional view of the cam 411 taken along a line 14–14 in FIG. 13A and FIG. 15 shows a sectional view taken along a line 15—15.

As shown in FIGS. 14 and 15, the cam 411 has a cam surface 411' and a collar 413 which contacts to the cam surface 411' follows an arcuate locus around pivot points 410 of the movable levers 204'. The cam surface 411' is angled to push up the collar 413 in a rotational tangential direction E against the spring forces of the spring contacts 203.

In the present embodiment, the rotation of the collar 413 of the movable lever 204' is imparted by utilizing the sloped surface 411' of the cam 411 so that the advanced contacts in the contact position can be retracted. Since the sloped surface 411' of the cam follows the locus of the rotation of the collar 413, the collar 413 can be smoothly driven.

Since the cam surface 411' is angled to be always in the tangential direction of the rotation of the collar 413, it acts physically advantageously. Since the total load to the contacts is more than 5 Kg, it is necessary to reduce the drive force of the movable lever 204' (the force against the spring pressures of the contacts). By pushing downwardly the lever tangentially, the movable lever 204' can be driven against the spring forces of the contacts with smaller drive force.

The distance between action points of load is equal to the distance between the center of the collar 413 and the pivot point 410. This means that the distance between the movable lever 204' and the pivot point 410 is maximum. Because of the large distance between the pivot point 410 and the collar 413, the contacts 203 can be moved to the non-contact position with small effort.

While the cam is used as the control means in the above description, a screw, a gear or a link mechanism may be used to attain the same effect.

In accordance with the present embodiment, the contacts can be moved to the contact position and the non-contact position with small effort. By moving the contacts by the cam, the contacts can be automatically moved to the non-contact position. Thus, the highly reliable connector which allows easy insertion of an object to be inserted is provided.

(3) Third embodiment

Figure 16A:
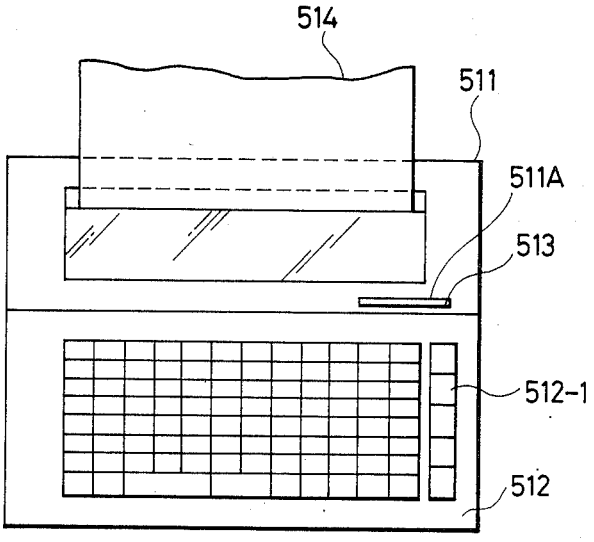
Figure 16B:
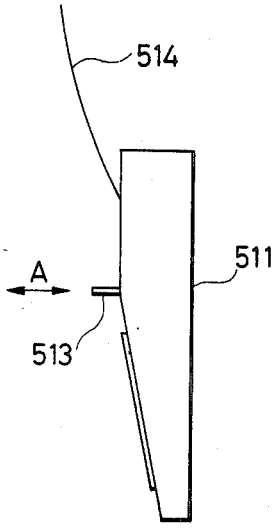
Figure 17:
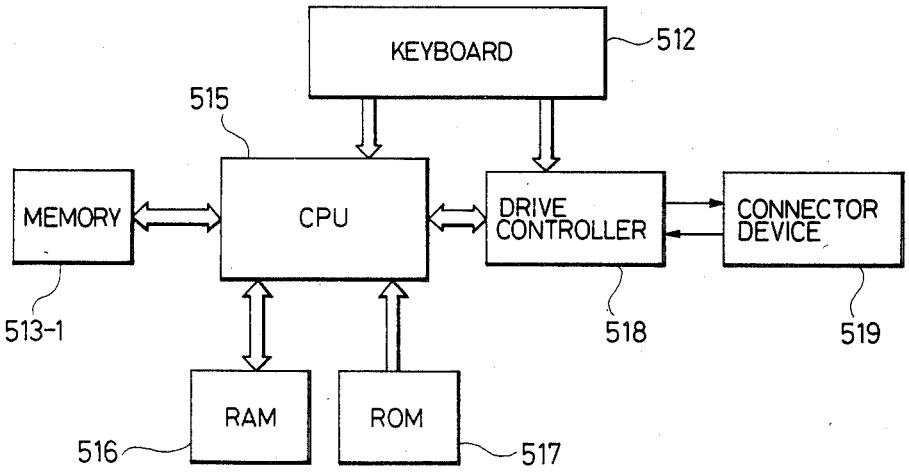
FIG. 17 is a block diagram showing a function of the electronic equipment of FIG. 16.
Figure 18:
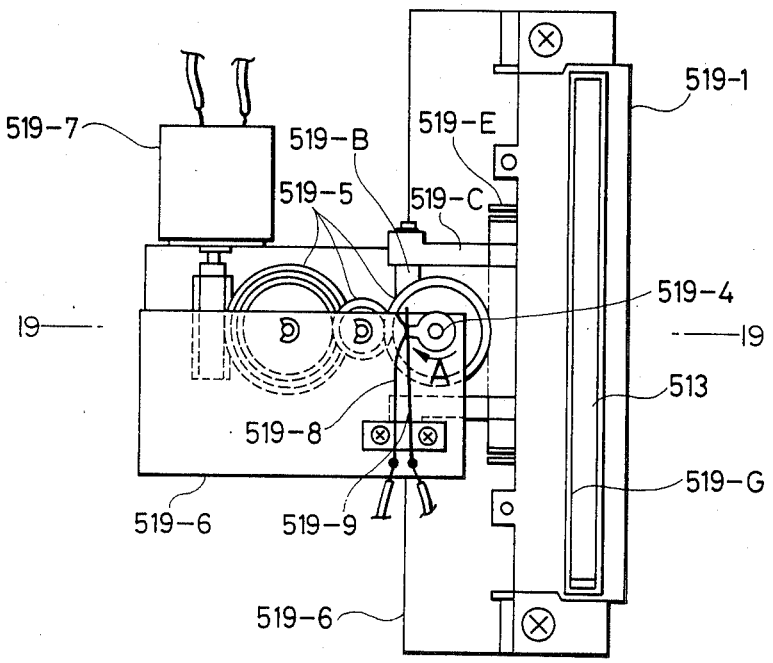
FIG. 18 is a plan view of the connector of another embodiment of the present invention.
Figure 19:
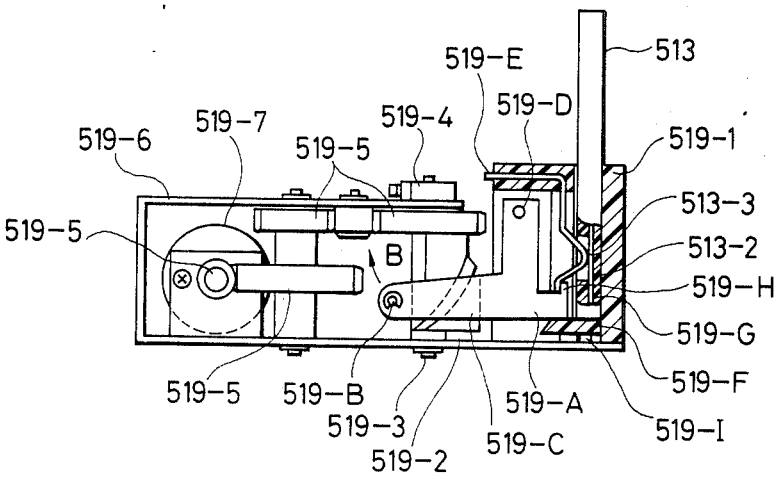
FIG. 19 is a sectional view taken along a line 19—19 in FIG. 18, FIGS. 20A and 20B are partial sectional views illustrating the operation of the connector.
Figure 20A:
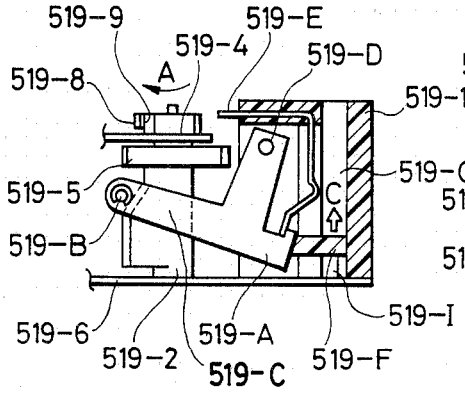
Figure 20B:
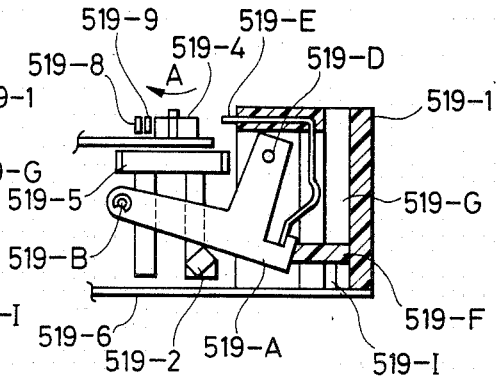

FIGS. 16A and 16B show external views of an embodiment of electronic equipment of the present invention, in which FIG. 16A is a plan view and FIG. 16B is a side view. FIG. 17 is a block diagram illustrating a function of the electronic embodiment. FIG. 18 is a plan view of a connector arranged in the electronic equipment. FIG. 19 is a sectional view taken along a line 19—19 in FIG. 18, and FIGS. 20A and 20B are partial sectional views of FIG. 19 showing processes of the operation.

Figure 24:
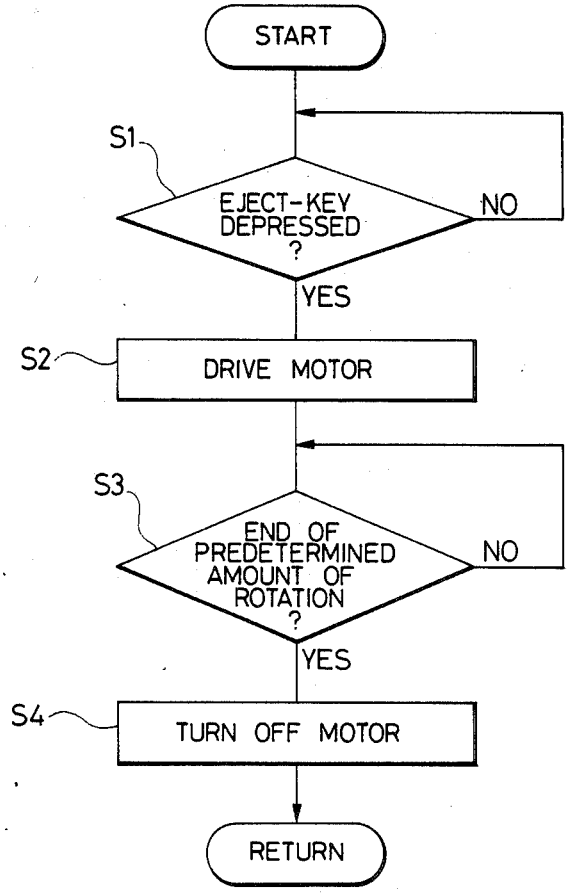
FIG. 24 is a flow chart showing a control procedure.

In FIGS. 16A, 16B and 17, numeral 511 denotes an electronic equipment main frame, numeral 512 denotes a keyboard of the electronic equipment, numeral 512-1 denotes a memory pack eject key of the connector, numeral 513 denotes a memory pack, numeral 513-1 denotes a memory such as ROM or RAM contained in the memory pack, numeral 514 denotes a print paper of the electronic equipment such as a printer, numeral 515 denotes a central processing unit (CPU) having a ROM containing a control program therein in accordance with a flow chart shown in FIG. 24, numeral 516 denotes a RAM in the electronic equipment, numeral 517 denotes a ROM in the electronic equipment, numeral 518 denotes a drive control circuit for the connector, and numeral 519 denotes the connector. The drive control circuit 518 operates in accordance with signals from the CPU 515 resulting from the execution of the control program in the CPU 515.

The connector 519 is mounted in the electronic equipment 511. A memory pack insertion port 511A is formed on the top of the housing of the electronic equipment main frame 511, and the memory pack 513 is inserted and removed in a direction A. In the connector 519, the memory pack 513 is inserted by a user through the insertion port 511A of the electronic equipment.

When the memory pack 513 is to be removed from the electronic equipment main frame 511, the memory pack eject key 512-1 on the keyboard 512 is depressed so that it is automatically removed. The operation of the connector 519 is controlled by the drive control circuit 518 of the connector 519 in accordance with the control program in the CPU 515.

The connector of the electronic equipment in the present embodiment will now be explained in detail. In FIGS. 18, 19, 20A and 20B, numeral 513-2 denotes a printed circuit board of the memory pack 513 on which a memory 513-1 such as ROM or RAM in the memory pack is mounted, numeral 513-3 denotes a contact pattern extending from the case of the memory pack 513 mounted on the printed circuit board 513-2, numeral 519-1 denotes a connector main body, numeral 519-A denotes a lever for the connector contacts, numeral 519-B denotes a cam follower shaft mounted on a movable arm 519-C of the lever 519-A, numeral 519-D denotes a pivot point of the lever 519-A, numeral 519-E denotes connector contacts, numeral 519-F denotes a lift member mounted at the bottom of an insertion port 519-G for the memory pack 513, and numeral 519-H denotes an engagement of the lever 519-A to which the ends of the connector contacts 519-E engage. The connector contacts 519-E have spring forces tending to flex toward the insertion port 519-G and the lever 519-A is normally biased toward the insertion port 519-G by the spring forces of the connector contacts 519-E. A leaf spring 519-I which pushes the lift member 519-F upwardly is mounted at the bottom of the lift member 519-F. Two movable arms 519-C extend from the lever 519-A and the cam follower shaft 519-B is rotatably mounted on the two movable arms 519-C. The insertion port 519-G is positioned to face the insertion port 511A of the electronic equipment main frame 511.

Numeral 519-2 denotes a spiral cam rotatably supported by a shaft 519-3 to frame 519-6 to engage with the movable arms 519-C and the cam follower shaft 519-B, numeral 519-4 denotes an end of one cycle detection cam which is mounted on a shaft 519-3 of the cam 519-2 and rotated with the cam 519-2, numeral 519-5 denotes a gear train for reducing the rotation of a motor and conveying the rotation to the cam 519-2, numeral 519-7 denotes the motor, and numerals 519-8 and 519-9 denote end of one cycle detection contacts.

In FIGS. 18 and 19, the memory pack 513 is mounted in the connector 519 and the connector contacts 519-E are contacted to the contact pattern 513-3 of the memory pack 513. The information in the memory 513-1 is transferred to the RAM in the electronic equipment through the manipulation of the keyboard 512 under the control of CPU 515, or the content of the RAM 516 or the ROM 517 is written into the RAM of the memory pack 513.

The operation to remove the memory pack 513 from the connector 519 will now be explained with reference to the flow chart of FIG. 24. As the memory pack eject key 512-1 on the keyboard 512 is depressed, the depression of the eject key is detected in a step Sl, and a signal is applied to the drive control circuit 518 of the connector 519 in a step S2 to rotate the motor 519-7. In a step S3, the motor is rotated by a predetermined rotational angle. The rotation is reduced by the gear train 519-5 with the increase of torque, and it is conveyed to the cam 519-2 which is then rotated at a predetermined rotational speed. As the cam 519-2 rotates, the cam follower shaft 519-B pivoted to the lever 519-A is pushed up in the direction B by the cam 519-2 and the lever 519-A is rotated around the pivot point 519-D against the spring forces of the connector contacts 519-E. On the other hand, the other ends of the connector contacts engage with the engagement 519-H of the lever 519-A and are pulled away from the contact pattern 513-3 of the memory pack 513 as the lever 519-A is rotated. As the lever is further rotated, the lift member 519-F pushed upwardly by the leaf spring 519-I disengages from the lever 519-A, (the connector contacts 519-E are sufficiently away from the memory pack 513 at this moment), and the lift member 519-F is lifted by the leaf spring 519-I in the direction C to push up the memory pack 513.

Since the lever 519-A engages with the lift member 519-F as shown in FIG. 20A, the lever 519-A is kept at the position of FIG. 20A even after the cam follower shaft 519-B is disengaged from the cam surface of the cam 519-2 as shown in FIG. 20B and in spite of the action of the spring forces of the connector contacts 519-E. The end of one cycle detection cam 519-4 supported on the shaft 519-3 of the cam 519-2 rotates to contact the detection contact 519-9 to the detection contact 519-8. This is done in the step S3. After the predetermined angle of rotation, a step S4 is carried out. In the step S4, as an end of one cycle signal is supplied to the drive control circuit 518, the motor 519-7 is deenergized and the one cycle of operation is completed. FIG. 20B shows a stand-by position for the insertion of the memory pack. At this position, the connector contacts 519-E are away from the insertion port 519-G for the memory pack.

When the memory pack 513 is to be inserted, the memory pack 513 is first inserted into the insertion port 519-G. As the lift member 519-F at the bottom of the memory pack 513 is pushed downwardly against the force of the leaf spring 519-I, the lift member 519-F is disengaged from the lever 519-A and the lever 519-A is rotated by the spring forces of the connector contacts 519-E in the opposite direction to the direction B. The connector contacts 519-E advance in the direction of the insertion port 519-G, that is, in the direction to contact the contact patterns 513-3 of the memory pack 513 and finally reach the position shown in FIG. 19. Thus, the memory pack 513 is mounted in position and the connector contacts 519-E are press-contacted to the contact pattern 513-3 of the memory pack 513 with a constant contact pressure.

It is important to note that the connector contacts 519-E are out of the insertion port 519-G of the memory pack 513 before the insertion of the memory pack 513, and when the memory pack 513 is inserted, the connector contacts 519-E do not contact to any portion of the memory pack 513, and at the end of the insertion, the connector contacts 519-E go toward the memory pack 513 to press-contact thereto.

The electronic equipment of the present embodiment can attain highly reliable connection of the memory package. Since the memory pack can be removed by depressing the memory pack eject key, the operability is improved.

In accordance with the present embodiment, the highly reliable connection of the memory package is attained and the memory pack can be removed by depressing the eject key. Thus, the operability of the electronic equipment is improved.

(4) Fourth embodiment

Figure 21:
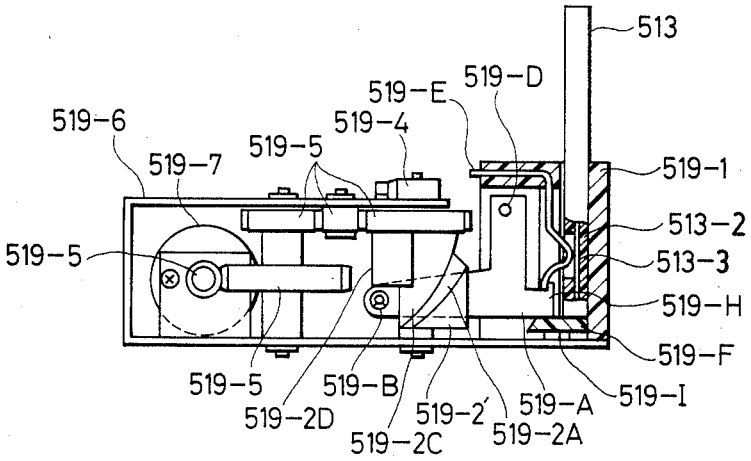
FIG. 21 is a sectional view of the connector of another embodiment of the present invention.
Figure 22:
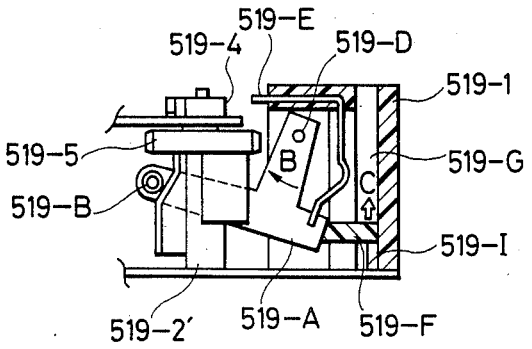
FIG. 22 is a partial sectional view illustrating the operation of the connector.

The plan view and side view of an electronic equipment having a connector equipped therein in accordance with the present embodiment are similar to those shown in FIGS. 16A and 16B. A block diagram showing a function of the electronic equipment is similar to that of FIG. 17 and a plan view of the connector is similar to that of FIG. 18. FIG. 21 is a sectional view taken along a line 19—19 in FIG. 18 and FIG. 22 is a partial sectional view of FIG. 21.

Figure 23:
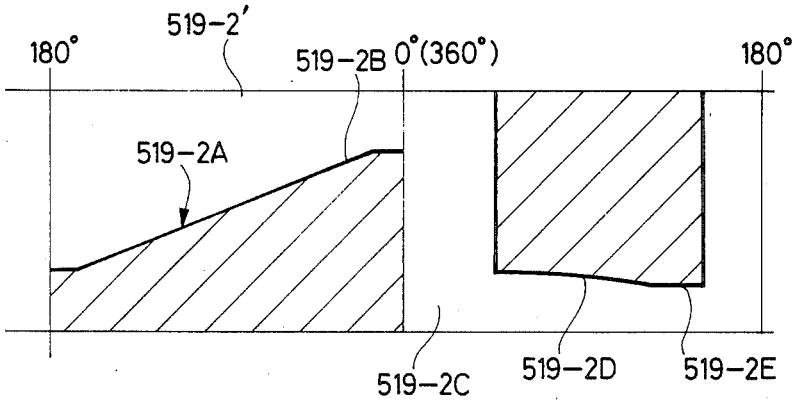
FIG. 23 is a cam diagram of a cam used in the connector.

A difference from the third embodiment resides in a cam 519-2' which is explained in detail with reference to a cam diagram of FIG. 23. Immediately before the lever 519-A is completely pushed up by a slope 519-2A, the lever 519-A engages with the lift member 519-F at a point 519-2B on the slope 519-2A, and the lever 519-A is then slightly pushed upwardly and goes into a non-sloped area 519-2C of the cam 519-2. (At this moment, the lever 519-A has been locked by the lift member 519-F.)

When the memory pack 513 is to be mounted, the memory pack 513 is inserted into the insertion port 19-G. As the lift member 519-F is pushed downwardly by the bottom of the memory pack 513 against the force of the leaf spring 519-I, the lift member 519-F is disengaged from the lever 519-A, and the lever 519-A is rotated in the opposite direction to the direction B by the spring forces of the connector contacts 519-E because the cam follower shaft 519-B is in a free state as shown by the cam diagram of FIG. 23. The connector contacts 519-E advance in the direction of the insertion port 519-G, that is, in the direction to contact the contact pattern 513-3 of the memory pack 513, and finally assume the position shown in FIG. 21. As a result, the memory pack 513 is inserted in position and the connector contacts 519-E go into the memory pack 513 and are press-contacted to the contact pattern 513-3 with a constant contact pressure A signal is produced by a switch (not shown) linked to the above operation so that the motor 519-7 is rotated and the cam 519-2' is rotated. Thus, the cam follower shaft 519-B is pushed downwardly by the slope 519-2D of the cam 519-2'. As a result, the connector contacts 519-E are urged to the contact pattern 513-3 with a larger force than that when the cam follower shaft 519-B is at 519-2C of the cam 519-2'. Thus, the connector contacts 519-E and the contact pattern 13-3 are positively contacted and the reliability is improved. When the cam follower shaft 519-B reaches 519-E of the cam diagram of FIG. 23, a signal is produced by a switch (not shown) so that the motor 519-7 is deenergized and held in this state until the memory pack eject switch 512-1 on the keyboard 512 is depressed to remove the memory pack 513.

It is important to note that the connector contacts 519-E are out of the insertion port 519-G of the memory pack 513 before the insertion of the memory pack 513, and when the memory pack 513 is inserted, the connector contacts 519-E do not contact to any portion of the memory pack 513, and at the end of insertion, the connector contacts 519-E go into the memory pack 513 to contact thereto. In the next step, the lever 519-A is pushed downwardly to forcibly urge the connector contacts 519-E to the connector pattern 513-3 to improve the reliability of the contact.

Because of the slope 519-2D of the cam 519-2', the contact force is imparted by the cam 19-2' to the connector contacts 519-E when they are contacted to the contact pattern 513-3 of the memory pack 513. Accordingly, it is not necessary to produce the contact force between the connector contacts 519-E and the contact pattern 513-3 only by the spring forces of the connector contacts 519-E. Accordingly, a spring constant of the contact may be relatively small, and the load to the cam 519-2' or the load to the motor 519-7 applied when the connector contacts 519-E are to be removed from the memory pack insertion portion can be reduced.

In accordance with the present embodiment, the contact is positive and reliable because the connector contacts are urged to the memory pack contacts by the cam.

Further, the operability for the insertion and removal of the memory pack is improved because the memory pack is automatically removed by the motor and the cam.

What is claimed is:

1. An external pack connector providing connection to an external pack, said connector comprising:

means defining a recess for receiving an external pack by insertion thereinto in an insertion direction;

table means slidably mounted in said recess and biased in a direction opposite to the insertion direction of said external pack;

securing means for securing said external pack in said recess by projecting into said recess as said table means is moved in the insertion direction of said external pack by the insertion of said external pack;

flexible contact means for electrically connecting with said external pack, said contact means biasing said securing means to project into said recess by a spring force thereof;

rotatable lever means fixed to said securing means; and rotation means for rotating said lever means to retract said securing means against the spring force of said contact means.

2. An external pack connector according to claim 1 further comprising a leaf spring for biasing said table means.

3. An external pack connector according to claim 1 wherein said securing means is a pin adapted to be fitted to a hole formed in said external pack.

4. An external pack connector according to claim 1 wherein said rotation means is a cam.

5. An external pack connector according to claim 1 further comprising a motor for driving said rotation means.

6. An external pack connector according to claim 1 wherein said lever means is biased by said contact means.

7. An electronic apparatus having an external pack connector providing connection to an external pack having a contact, said connector comprising:

a body defining a recess for receiving an external pack;

contact means for contacting said contact of said external pack;

control means for urging said contact means toward and for moving said contact means away from said contact of said external pack;

drive means disposed to one side of said recess, on said body, for driving said control means; and a switch, on said body, for controlling said drive means.

8. An external pack connector according to claim 7 wherein said drive means includes a motor.

9. An external pack connector according to claim 7 wherein said control means comprises a cam and a motor for driving said cam, and wherein said cam is shaped to have a portion which does not urge said contact means toward said contact of said external pack and does not move said contact means away from said contact of said external pack.

* * * * *

UNITED STATES PATENT AND TRADEMARK OFFICE

CERTIFICATE OF CORRECTION

PATENT NO. : 4,801,272

DATED : January 31, 1989

INVENTOR(S) : MANABU KANAZAWA, ET AL.

It is certified that error appears in the above-identified patent and that said Letters Patent is hereby corrected as shown below:

COLUMN 1

Line 4, "continuation-in-part" should read --continuation--.

COLUMN 2

Line 5, "contacts 04)," should read --contacts 104),--.

COLUMN 3

Line 66, "FIGS. 13A to 13B" should read --FIGS. 13A to 13E--.

COLUMN 10

Line 45, "cam 19-2'" should read --cam 519-2'--.

Signed and Sealed this

Fifth Day of September, 1989

*Attest:*

*Attesting Officer*

DONALD J. QUIGG

*Commissioner of Patents and Trademarks*